US006374429B1

(12) United States Patent
Velasco

(10) Patent No.: US 6,374,429 B1
(45) Date of Patent: Apr. 23, 2002

(54) JOHNNYFLUSH

(76) Inventor: John Velasco, 4571 Oakfield Cir., Dade City, FL (US) 33523

( * ) Notice: Subject to any disclaimer, the term of this patent is extended or adjusted under 35 U.S.C. 154(b) by 29 days.

(21) Appl. No.: 09/685,591

(22) Filed: Oct. 11, 2000

Related U.S. Application Data

(60) Provisional application No. 60/166,743, filed on Nov. 22, 1999.

(51) Int. Cl.[7] ..... E03D 5/04
(52) U.S. Cl. ..... 4/408; 4/250
(58) Field of Search ..... 4/408, 250, 249

(56) References Cited

U.S. PATENT DOCUMENTS

| | | | | | |
|---|---|---|---|---|---|
| 668,999 | A | * | 2/1901 | Osborn | 4/408 |
| 920,928 | A | * | 5/1909 | Davis | 4/408 |
| 959,717 | A | | 5/1910 | Christensen | |
| 1,337,730 | A | * | 4/1920 | Sloan | 4/250 |
| 1,595,741 | A | * | 8/1926 | Sweeney | 4/250 |
| 2,628,363 | A | * | 2/1953 | Stein | 4/395 |
| 4,329,745 | A | | 5/1982 | Aguero | |
| 4,338,690 | A | | 7/1982 | Hsieh et al. | |
| 4,573,223 | A | * | 3/1986 | Schmidt | 4/408 |
| 4,974,263 | A | | 12/1990 | Sheppard et al. | |
| 5,319,810 | A | | 6/1994 | Metzger | |
| 5,369,816 | A | * | 12/1994 | Chen | 4/408 |
| 5,410,766 | A | | 5/1995 | Schumacher | |

FOREIGN PATENT DOCUMENTS

| | | | | |
|---|---|---|---|---|
| IT | 570823 | * | 12/1957 | 4/250 |

* cited by examiner

*Primary Examiner*—Gregory Huson
*Assistant Examiner*—Huyen Le
(74) *Attorney, Agent, or Firm*—Patent & Trademark Services; Joseph H. McGlynn

(57) ABSTRACT

An automatic flushing mechanism which has two sets of rollers mounted to the underside of a toilet seat by a series of levers and connecting brackets. A pull rod is connected at one end to the rollers and at the other end to a pull chain which is in turn connected to the flush handle on the toilet.

10 Claims, 10 Drawing Sheets

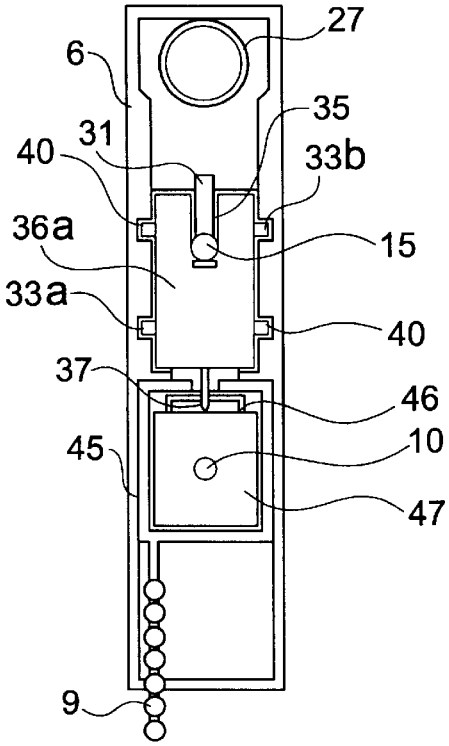
FIG.18a
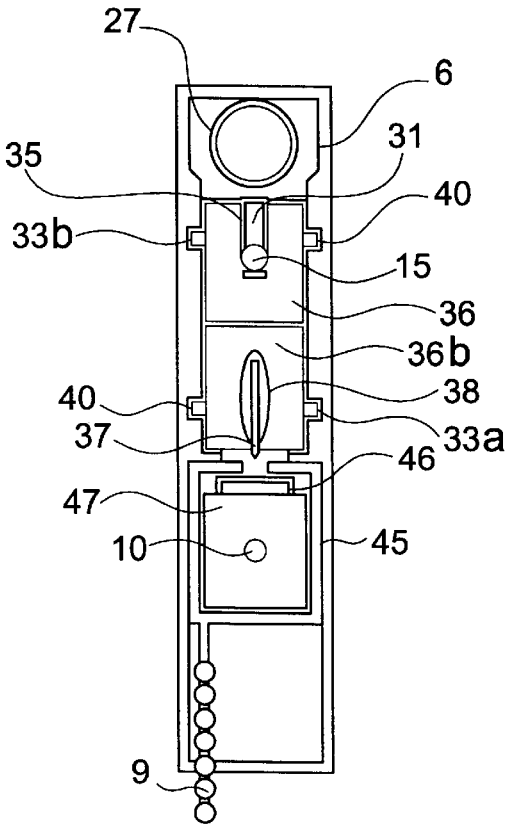
FIG.18b
FIG.19
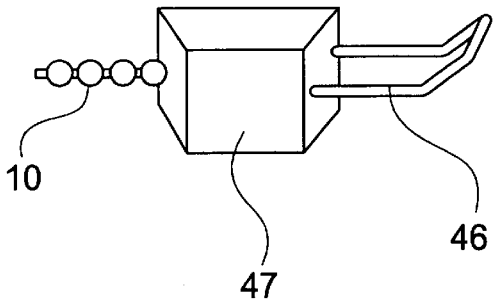

JOHNNYFLUSH

This application claims benefit of No. 60/166,743 Nov. 22, 1999.

BACKGROUND OF THE INVENTION

This invention relates, in general, to toilets, and, in particular, to a self flushing toilet.

DESCRIPTION OF THE PRIOR ART

In the prior art various types of self flushing toilets have been proposed. For example, U.S. Pat. No. 959,717 to Christensen discloses an automatically flushing toilet which has a lever mounted on the underside of the toilet seat which operates a trigger mechanism to flush the toilet.

U.S. Pat. No. 4,329,745 to Aguero discloses an automatic weight operated toilet flushing device which automatically flushes the toilet when the user gets up from the seat.

U.S. Pat. No. 4,338,690 to Hsieh et al discloses an automatic flushing mechanism which raises the seat to a vertical position automatically which also flushes the urinal.

U.S. Pat. No. 4,974,263 to Sheppard et al discloses an automatically flushing toilet in which the toilet is flushed when the toilet seat is moved from the up to the down position.

U.S. Pat. No. 5,319,810 to Metzger discloses a flushing system which has a water line connected so that when the toilet seat is moved to a horizontal or closed position tension on the line will cause the toilet to be flushed.

U.S. Pat. No. 5,349,703 to Mocilnikar et al discloses a hinge which has a toothed sprocket which activates the flushing mechanism when the hinge is rotated in one direction.

U.S. Pat. No. 5,410,766 to Schumacher discloses an automatic flushing mechanism with a trippable flapper valve which is tripped when the toilet seat cover is moved to the closed position.

SUMMARY OF THE INVENTION

The present invention is directed to an automatic flushing mechanism which has two sets of rollers mounted to the underside of a toilet seat by a series of levers and connecting brackets. A pull rod is connected at one end to the rollers and at the other end to a pull chain which is in turn connected to the flush handle on the toilet.

It is an object of the present invention to provide a new and improved automatic toilet flushing system.

It is an object of the present invention to provide a new and improved automatic toilet flushing system which can be retrofitted to an existing toilet.

It is an object of the present invention to provide a new and improved automatic toilet flushing system which is inexpensive to manufacture and can be installed by non-professionals.

These and other objects and advantages of the present invention will be fully apparent from the following description, when taken in connection with the annexed drawings.

BRIEF DESCRIPTION OF THE DRAWINGS

FIGS. 18*a,* 18*b* and 19 are views showing the shuttle and clasp of the present invention.

DESCRIPTION OF THE PREFERRED EMBODIMENT

Figure 3:
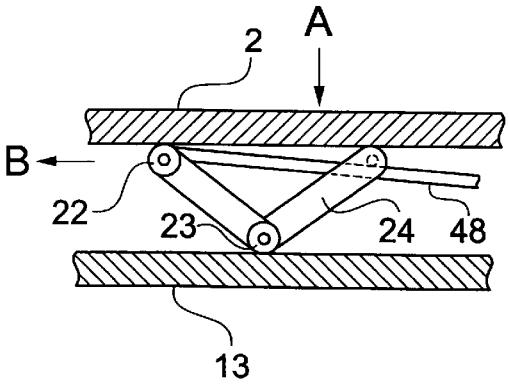
FIG. 3 is a side view of the present invention attached. to a toilet seat with weight on the seat.
Figure 4:
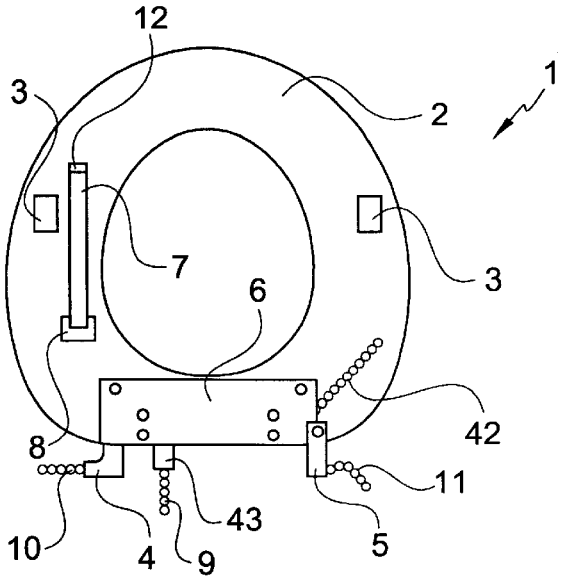
FIG. 4 is a plan view of the present invention attached to a toilet seat.

Referring now to the drawings in greater detail, FIG. 4 shows the under side of a toilet seat which incorporates the present invention 1. As shown in FIG. 4 the control box 6, which houses the internal mechanism that operates the present invention is shown as being mounted on the seat 2 adjacent the end of the seat where the seat is hinged to the toilet bowl at 4, 5. Also shown is the apertures 3 which will house the roller mechanism 14 shown in FIGS. 1–3, which will be explained in greater detail below.

In addition, FIG. 4 shows the seat up lock lever 7 which is shown in the stowed position. The seat up lock lever 7 has a non-skid foot 12 attached thereto in any conventional manner, and the seat up lock lever 7 is pivotally attached to the underside of the seat 2 at 8 in any conventional manner. The roller assembly housed in the left aperture 3, in FIG. 4, does not connect to the control box 6, but is spring loaded and acts as a balance to the seat 2 while in the down position.

Figure 5:
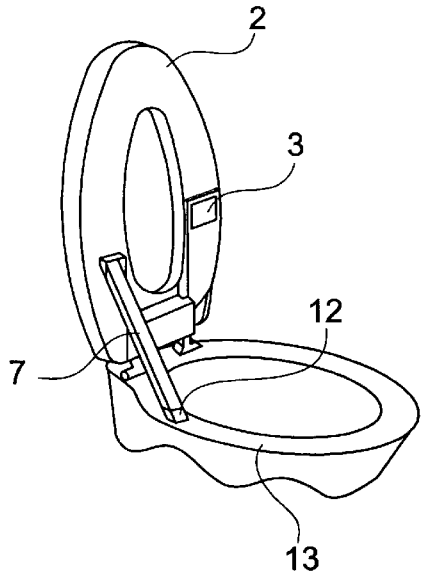
FIG. 5 is a perspective view of the present invention attached to a toilet seat with the seat in the up position.

FIG. 5 shows the seat up lock lever 7 in its in use position. The seat up lock lever 7 has been pivoted into a down position so the non-skid foot 12 engages the top 13 of the toilet bowl. In this position, the non-skid foot 12 and the seat up lock lever 7 will prop the seat 2 in the up position where the automatic flushing mechanism of the present invention will not operate. This position can be used, for example, if cleaning of the toilet bowl is being performed.

Also shown in FIG. 4 is third flexible connector which is a pull chain 10 which will be connected to the flush handle 50, on the toilet. Also shown in FIG. 4 are a fourth flexible connector, which is a lid pull chain 9, and a fifth flexible connector, which is a seat-up pull chain 11, and a first flexible connector which is a roller pull chain 42. These various pull chains are not shown as being connected to any components in this view. This view. is merely to show the locations of the pull chains as they exit the control box 6. However the chain 9 can be connected to the toilet seat lid by any conventional means such as, but not limited to, a hook 49. Also, the chain 11 can be connected to the toilet seat by any conventional means such as, but not limited to, a hook 49.

Figure 4A:
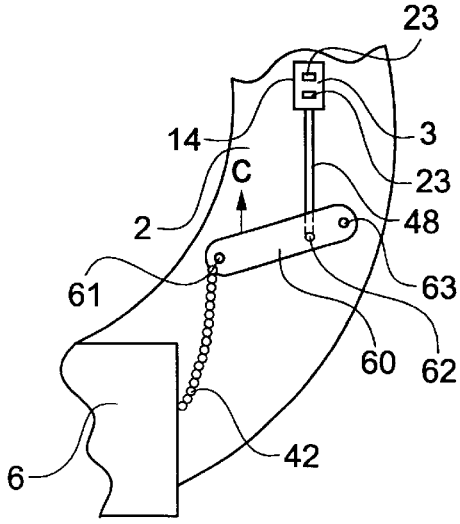
FIG. 4A is a close up view of the right side of the bottom of the seat.

FIG. 4A shows the pull chain 42 exiting the control box 6 and attaching to one end 61 of a lever 60, which is pivotally attached to the underside of the seat 2 at 63 in any conventional manner. Also, attached to the lever 60 at 62 is one end of the pull rod 48 which then extends into the roller mechanism 14 at the other end of the pull rod.

Figure 1:
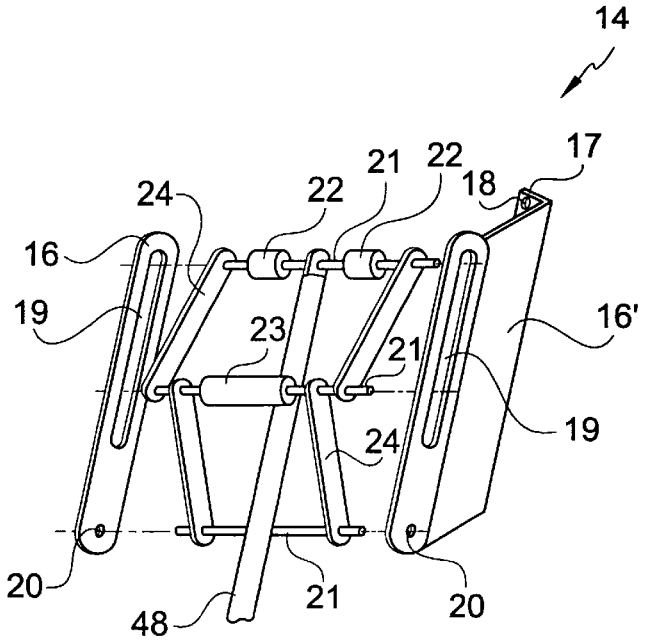
FIG. 1 is an exploded view of the rollers and linkage assembly of the present invention.
Figure 2:
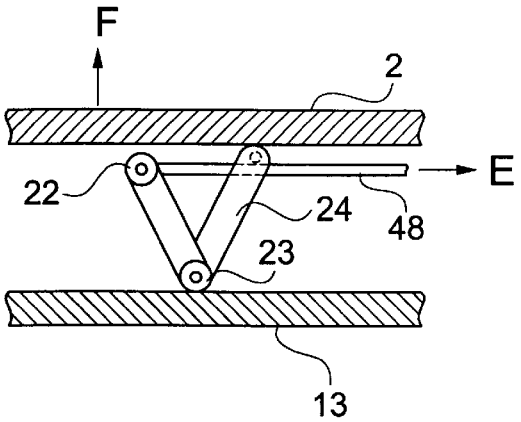
FIG. 2 is a side view of the present invention attached to a toilet seat with no weight on the seat.

FIGS. 1–3 show the roller mechanism 14 which is mounted on the underside of the toilet seat 2. FIG. 1 shows a perspective, exploded view of the roller mechanism, which comprises a pair of mounting brackets 16. Bracket 16' has mounting flange 17 with apertures 18 which can be used to fasten the bracket 16' to slot 19 on bracket 16 by means of any conventional fastener. Preferably the roller mechanism will be mounted within apertures 3 in the bottom of seat 2, however, the mechanism could also be mounted on the bottom surface without departing from the scope of the present invention.

The roller mechanisms are mounted in apertures 3 with the roller 23 protruding. Roller 23 rolls on the top of the rim of the toilet bowl 13, and the roller 22 rolls on the bottom of the toilet seat 2. The rollers 22, 23 are attached to axles 21 and the respective axles are secured by spacers 24. The axles pass through slots 19 and apertures 20, on brackets 16, 16' and are secured there by any conventional means. A pull rod 48 is secured to axle 21 which mounts the rollers 22.

As can be seen in FIGS. 2 and 3, when there is no pressure on the seat 2 the rollers will assume the position shown in FIG. 2, because of the tension of the mainspring 27 on pull rod 48 (see FIG. 7)in direction E, and when pressure is applied in the direction of arrow A, the seat 2 will move down, which will cause the rollers 22 to pivot, with respect to the roller 23, and move in the direction of the arrow B. This will cause the pull rod 48 to activate lever 60 which causes the pull chain 42 to move out of the control box in the direction of the arrow C, of FIG. 4A, thereby cocking the trigger shuttle 25 shown in FIGS. 8–12, which will be explained below.

Figure 8:
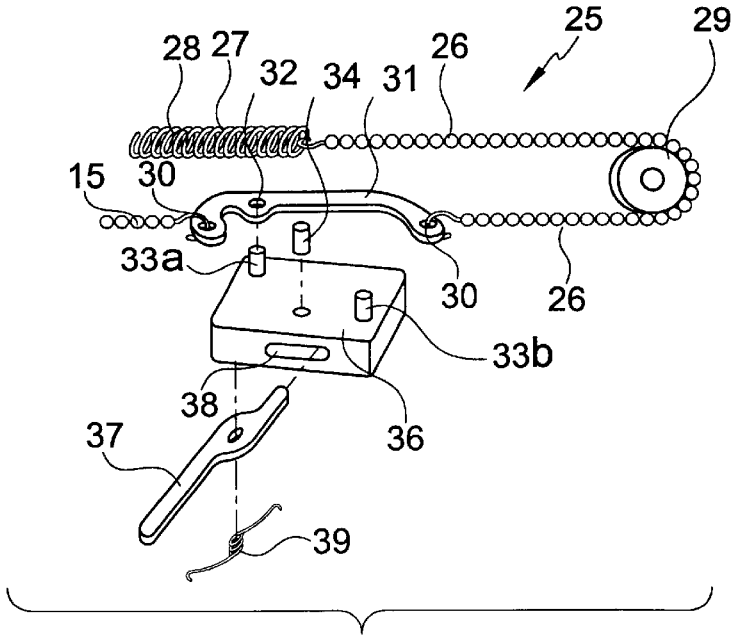
FIG. 8 is a partial perspective view of the trigger shuttle of the present invention.

FIG. 8 shows an exploded perspective view of the trigger shuttle assembly 25. It has a housing 36 with a trigger slot 38 which allows the trigger 37 to be pivotally secured in the housing 36 by pivot pin 34, and to protrude from the housing 36. A connector 31 is mounted through slot 35 (see FIGS. 9 and 11) and is pivotally connected within the housing by the upper left pivot pin 33*a* which extends through an aperture 32 in the connector 31. Once the trigger 37, trigger spring 39, and connector 31 are secured to the pivot pins 33, 34 they will be held in place by a cover (not shown) secured to the housing 36 in any conventional manner.

As shown in FIG. 8, the second flexible connector, which is a trigger shuttle pull chain 15, is secured at one end to the connector 31, and the mainspring pull chain 26 is secured at the other end of the connector 31 through apertures 30 in any conventional manner. The pull chain 26 passes around guide 29 and is connected to the mainspring 27 which is anchored at 28, by any conventional means.

Figure 9:
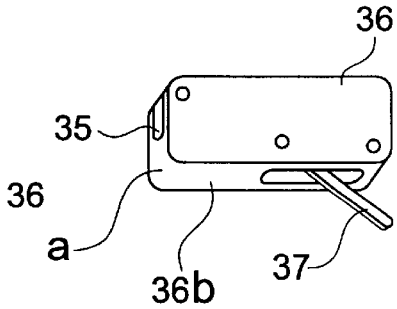
FIG. 9 is a partial perspective view of the trigger shuttle of the present invention showing the trigger in one position.
Figure 10:
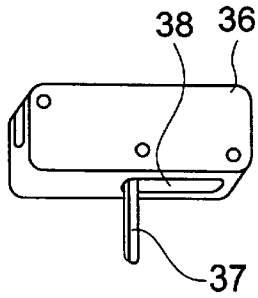
FIG. 10 is a partial perspective view of the trigger shuttle of the present invention showing the trigger in another position.
Figure 11:
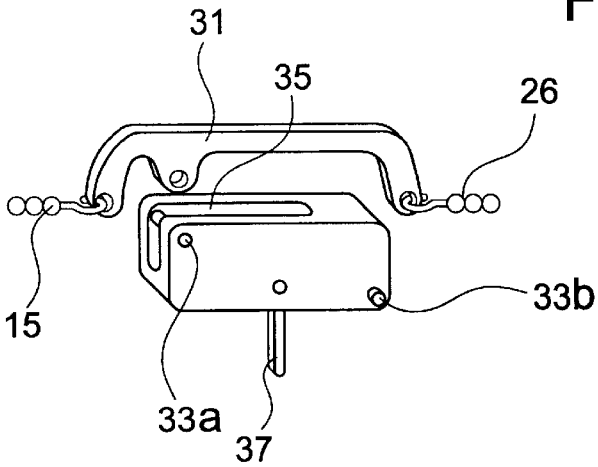
FIG. 11 is a partial perspective view of the trigger shuttle of the present invention showing the connector of the shuttle before it is inserted into the shuttle.

FIGS. 9 and 10 show the trigger 37 pivotally mounted in the housing 36 by pin 34 so that the trigger can rotate counterclockwise, but not clockwise from its normal position, shown in FIG. 10. The back and bottom faces 36*a* and 36*b* of the housing shown here are also shown in FIG. 18*b*.

Figure 12:
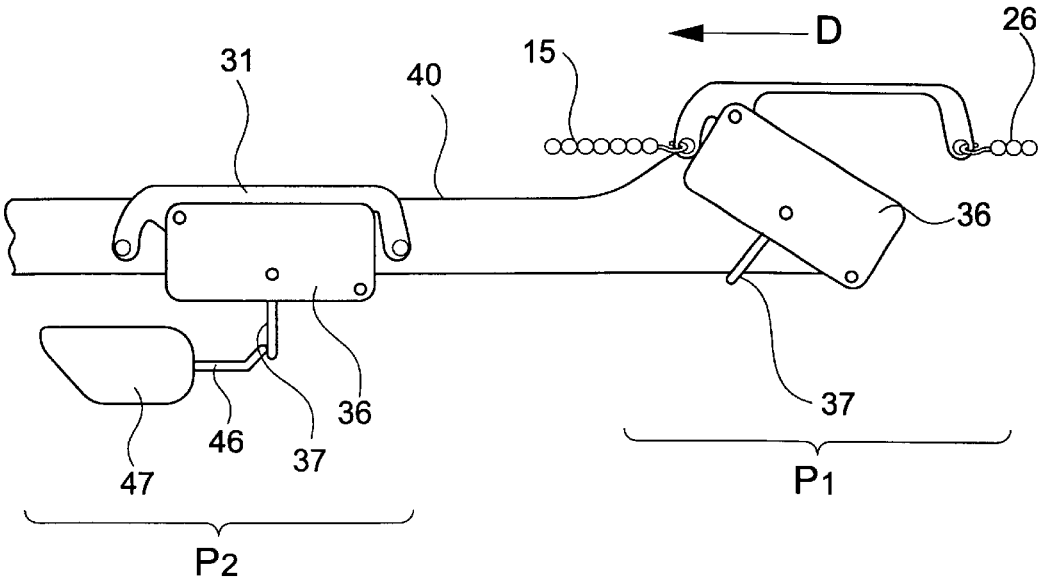
FIG. 12 is a partial plan view of the trigger shuttle of the present invention showing the shuttle in two of its positions.

FIG. 12 shows the two positions of the trigger shuttle 25. Before pressure is applied to seat 2 the shuttle will be in the at rest position, $P_1$ shown to the right of FIG. 12, where it will be held by pressure from spring 27 acting through chain 26. When pressure is applied to seat 2, as will happen when a person sits on the seat, pull chain 15 will be pulled in the direction of the arrow D (in FIG. 12) from the movement of the pull rod 48 in the direction of arrow B, as shown in FIG. 3, and the shuttle will be pulled by the chain 15 from the at rest position $P_1$, shown to the right in FIG. 12, to the cocked position $P_2$, shown to the left in FIG. 12, where pressure on the seat 2 will hold it against the spring tension of spring 27. When pressure on the seat 2 is removed (when a user stands up after sitting on the seat), the tension in spring 27 will pull the shuttle once more to the right into the at rest position $P_1$. This back and forth movement of the trigger shuttle will be guided by the shuttle sliding along the trigger shuttle track 40. It should be noted that the shuttle can have projections, which are the two pivot/guide pins 33, on the surface that are hidden in FIG. 12 and which will travel in the track 40, or the entire shuttle can be sized to travel in the track 40.

Figure 6:
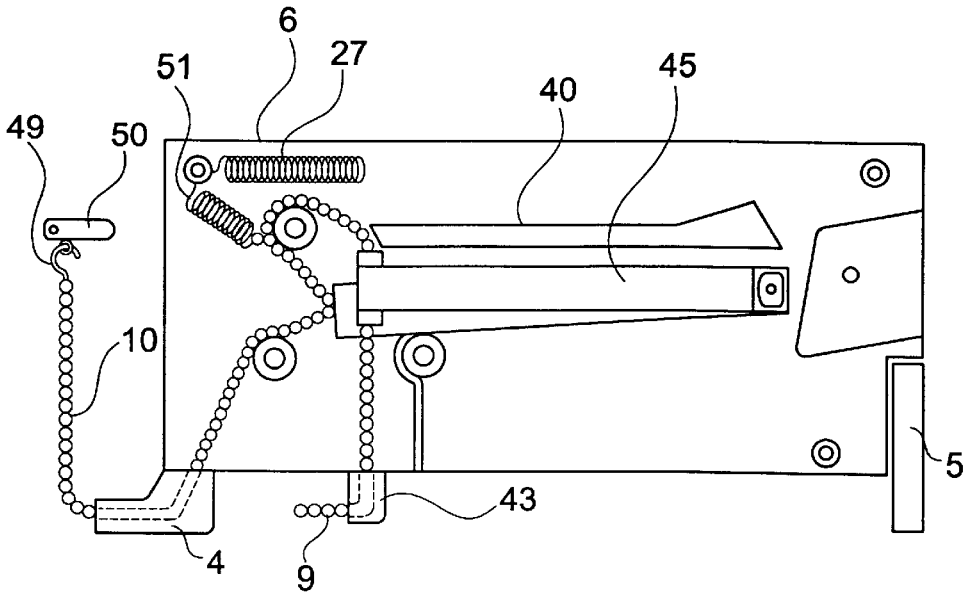
FIG. 6 is a plan view of the present invention showing some of the internal mechanism.

FIG. 6 shows the control box 6 with a portion removed to display the inner mechanism. Also, the trigger shuttle 36 and the clasp shuttle 47 have been removed from FIGS. 6 and 7 for clarity. As can be seen in FIG. 6, the position of the clasp shuttle track 45 is up when the toilet lid is in the upright position (not shown) due to the tension from the clasp return spring 51 (which also keeps the clasp shuttle to the left inside the clasp shuttle track 45). The hinge 4 extends to the left of the toilet seat 2 so the exit point of chain 10 positions chain 10 to the left so it doesn't interfere with the up and down position of the seat 2 or the lid (not shown).

Figure 7:
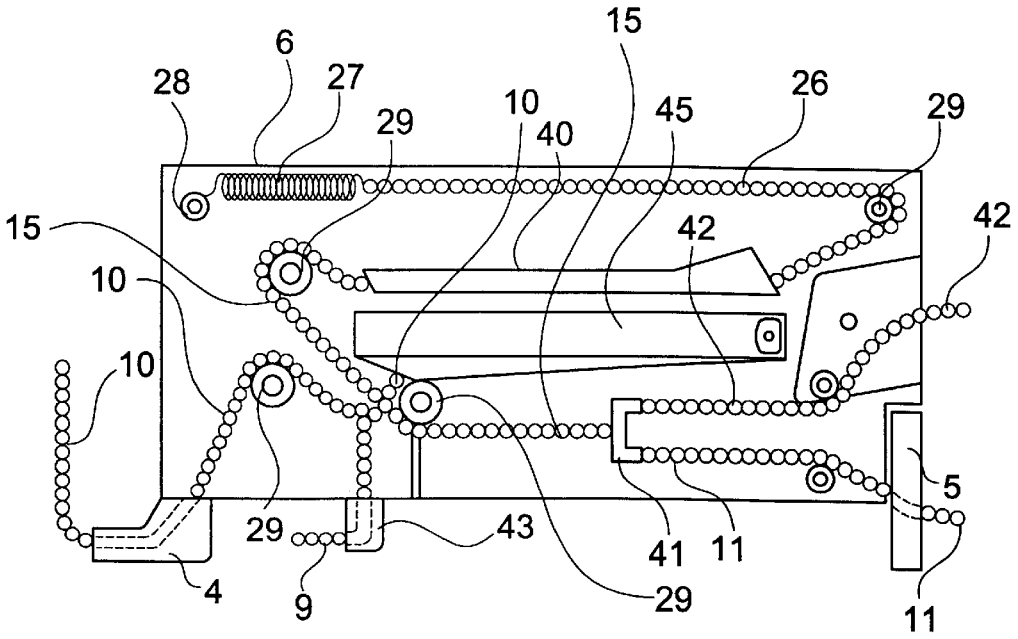
FIG. 7 is a plan view of the present invention showing other portions of the internal mechanism.

FIG. 7 shows the control box 6 with a portion removed to display the inner mechanism. As can be seen in FIG. 7, the mainspring 27 is mounted near the top of the box 6, and is connected to chain 26 which passes around guide 29 and then connects to the shuttle connector 31 attached to the shuttle trigger 36 (removed from FIG. 7 for clarity). The other end of the connector 31 is attached to the pull chain 15 which passes around a guide 29 and then around a second guide 29 and is connected to a pull chain connector 41 in any conventional manner. The pull chain connector 41 connects the chain 15 to the chain 42 and to the chain 11. Also shown is the position of the clasp shuttle track 45 when the lid (not shown) is in the down position.

Figure 13:
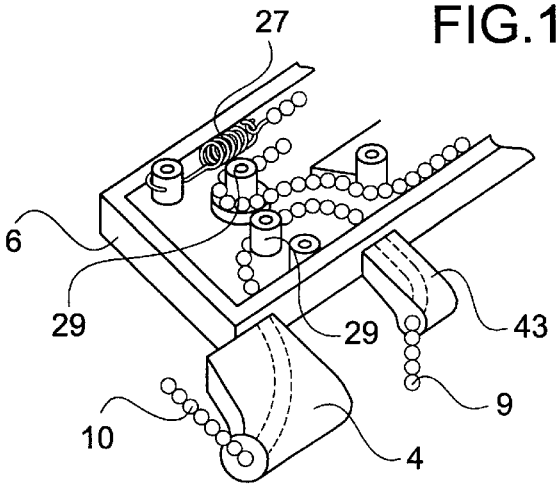
FIGS. 13–15 are partial perspective views showing the paths of the various pull chains of the present invention.
Figure 14:
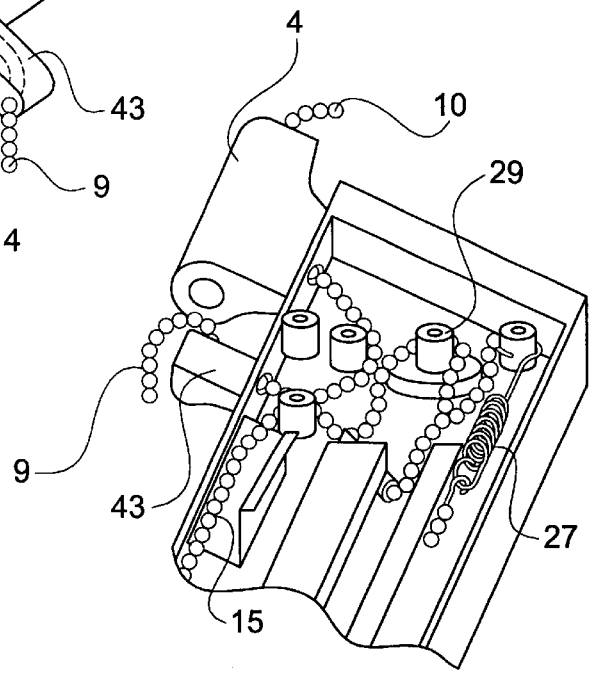

FIGS. 13 and 14 show a portion of the inside of the box 6 and the position of the spring 27, chain 10 and its exit through the hinge 4, and the chain 9 and its exit through element 43.

Figure 15:
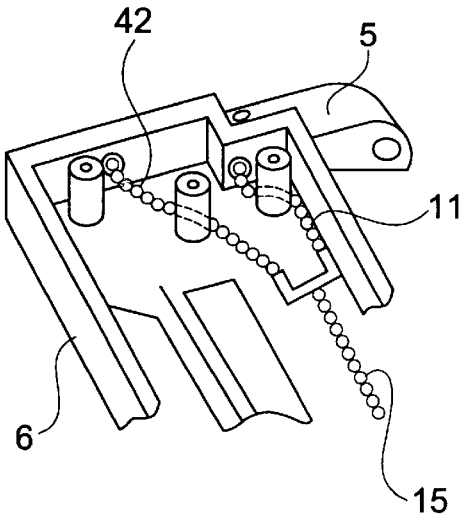

FIG. 15 shows a partial view of the box 6 with the hinge 5, the chain 11, the chain 15 and the chain 42. It also shows the positions where the chains 11 and 42 exit the box 6.

Figure 16:
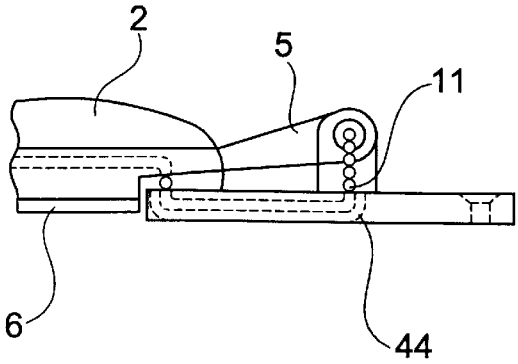
FIGS. 16 and 17 are partial side views showing the pull chains as they are passed through the seat hinges.
Figure 17:
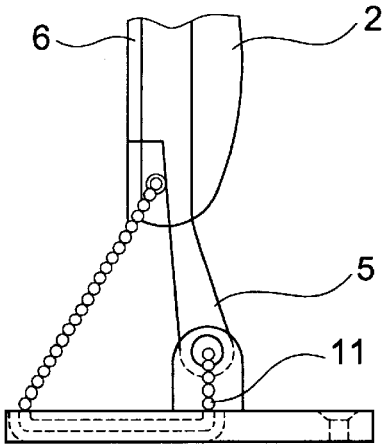

FIG. 16 shows a partial view of the present invention showing the seat 2, the box 6 and the hinge 5 with a passage 44 through the hinge for the pull chain 11 to exit the box 6, and pass through the hinge and to exit the hinge. FIG. 16 shows the seat 2 in the down position, while FIG. 17 shows the seat in the up position.

Figure 20A:
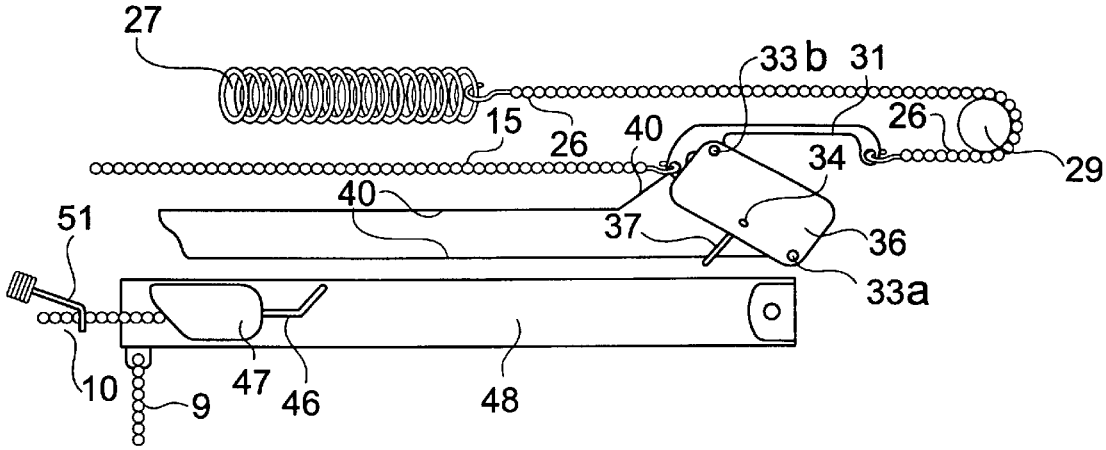
FIGS. 20*a*–20*h* show the shuttle and clasp in operation.
Figure 20B:
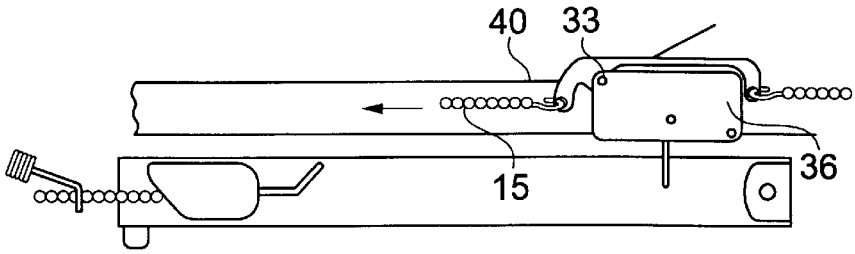
Figure 20C:
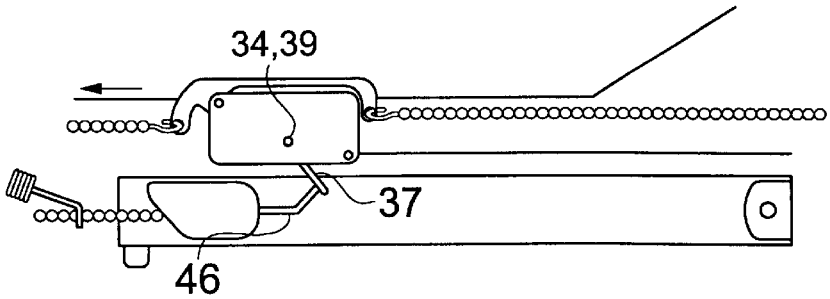
Figure 20D:
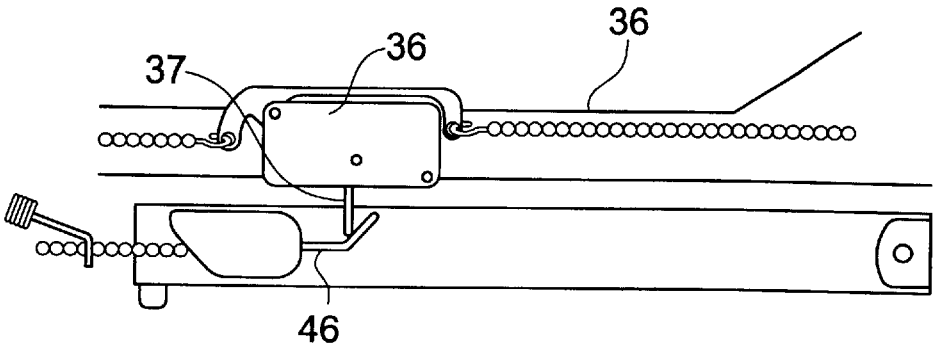
Figure 20E:
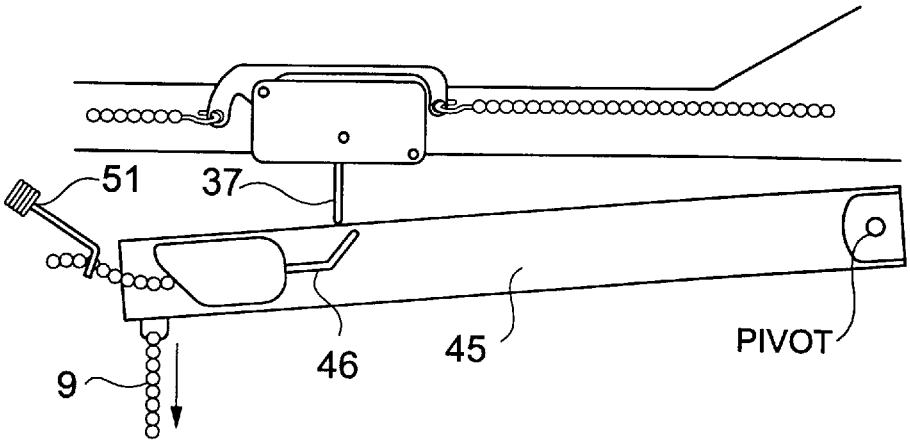
Figure 20F:
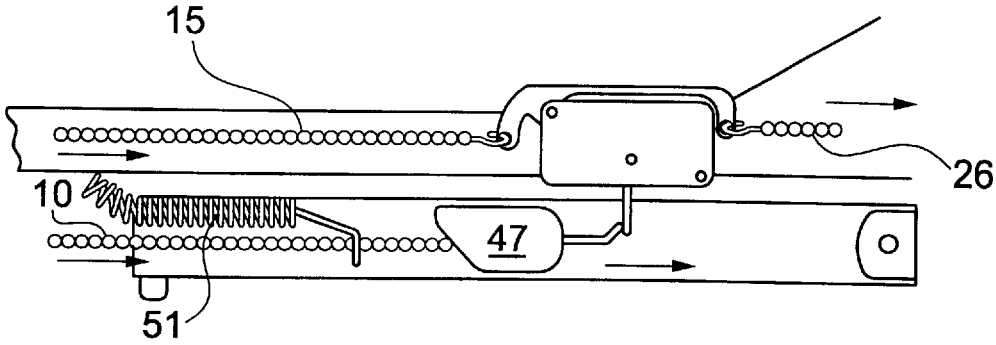
Figure 20G:
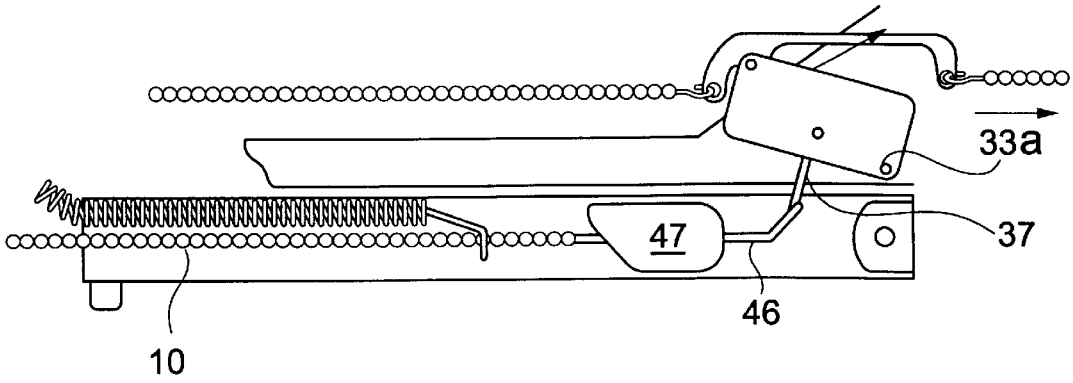
Figure 20H:
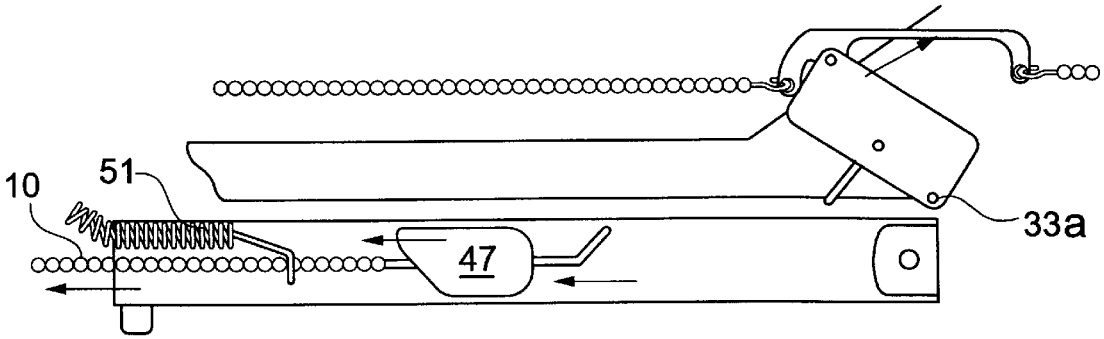

FIGS. 18*a* and 18*b* show the two positions of-the clasp shuttle 47 with respect to the clasp track 45, as viewed at FIGS. 20*f–g*. In FIG. 18*a,* the trigger 37 on the trigger shuttle 36 is engaged with the clasp 46 mounted on the clasp housing 47 which slides back and forth inside in the clasp track 45. When the clasp shuttle 47 is in the position shown in FIG. 18*a,* this corresponds to the position of the clasp shuttle 47, shown in $P_2$, to the left in FIG. 12, and the clasp shuttle 47 in now in the cocked position and the trigger 37 on the trigger shuttle 36 is secured by the shuttle clasp 46 along with the tension from the spring 27. In FIG. 18*b* the trigger shuttle 36 is shown in the at rest position and has pivoted, as shown in position $P_1$ in the right side of FIG. 12 to release the trigger 37 from the clasp 46 (see FIG. 19 for a more detailed showing of the clasp).

As shown in FIGS. 20*a*–20*h,* the clasp 46 and the clasp shuttle 47 form a rigid component (see also FIG. 19) which slides back and forth inside the clasp shuttle track 45. FIG. 20*a* shows the clasp shuttle 47 in the at rest position. FIG. 20*c* shows the trigger 37 on the trigger shuttle 36 rotating counterclockwise and pulled to the right by a person sitting on or lifting the seat 2. This also starts to put tension on the mainspring 27 (see FIG. 20*a*). The trigger 37 is spring loaded and will ride up and over the clasp 46 rotating counterclockwise as shown in FIGS. 20*c* and 20*d,* when the trigger shuttle 36 is pulled to the left as shown at $P_2$ on the left side of FIG. 12 and FIGS. 20*c* and 20*d,* which is the cocked position. At this point the trigger 37 is not touching the end of clasp 46. FIG. 20*e* shows the effect on clasp 45 when the lid is placed in the down position, pulling the clasp track 45, and with it the clasp 46, down out of engagement with the trigger 37. The trigger 37 cannot rotate clockwise, so when the clasp 46 and the trigger 37 are disengaged, tension is removed from chain 10, and the trigger shuttle is pulled to the right by chain 26 and spring 27.

The clasp shuttle 47 moves to the right, which moves both the clasp return spring 51 and chain 10 to the right, and the chain 10 pulls the handle 50, which flushes the toilet. When the trigger shuttle 36 reaches the far right, shown in FIG. 20*g,* the entire trigger shuttle 36 rotates clockwise, removing the trigger 37 from the clasp 46, allowing the clasp return spring 51 to pull the shuttle 47 back to the at rest position, shown at the left of FIG. 20*h*. The resetting toilet handle takes up the slack in pull chain 10, pulling it out of the control box 6 through the left hinge 4.

In use, when a person sits on the toilet seat 2, the roller mechanism will move from the position shown in FIG. 2 to the position shown in FIG. 3. This will cause the pull rod 48 to be pulled from the position shown in FIG. 2 to the position shown in FIG. 3. Pull rod 48 is connected to lever 60 (see FIG. 4A) which is connected to pull chain 42, which in turn is connected to connector 41 (see FIGS. 4A and 7). When the pull rod 48 is pulled from the position shown in FIG. 2 to the position shown in FIG. 3, (in the direction of arrow B), the pull chain 42 will be pulled to the right in FIG. 7. Since pull chain 42 is connected, through connector 41, to chain 15, this motion will pull the trigger shuttle 36 from the at rest position $P_1$, shown to the right in FIGS. 12 and 20*a,* to the position $P_2$ shown to the left in FIGS. 12 and 20*d* (the cocked position). This will stretch the spring 27.

As the trigger shuttle 36 moves to the left in FIG. 12, the trigger 37 will engage the trigger shuttle clasp 46, which is at the left end and inside the clasp shuttle track 45, (see FIGS. 20*a*–20*d*). The system is now in the cocked position, also shown in FIG. 18*a*. When the trigger shuttle 36 is pulled to the right in FIG. 12, position $P_1$, either by removing the weight from the seat or releasing the seat, the track 45 will pivot up from the position shown in FIG. 20*e* to the position shown in FIG. 20*f,* and the trigger 37 will reconnect to the clasp 46. The spring 27 will pull the trigger shuttle 36 and the connected clasp shuttle 47 to the right, as shown in FIGS. 12 and 20*f*. This, in turn, will pull chain 10 which will flush the toilet. At the same time, the clasp return spring 51 is stretched to the right.

When weight is removed from the seat 2, the tension in the mainspring 27 pulls the trigger shuttle 36 from the position $P_2$, shown in the left of FIG. 12, to the position $P_1$, shown in the right of FIG. 12 and also shown in FIG. 18*b*. At the same time tension from pull rod 48, in the direction E as shown in FIG. 2, pulls the roller assembly from the position shown in FIG. 3 to the position shown in FIG. 2, raising the seat 2 in direction F, the at rest position, which is the same position shown in FIG. 2.

Considering FIGS. 7, 16 and 17, the function of the seat up pull chain 11 will now be explained. As shown in FIG. 7. one end of the pull chain 11 is connected to the connector 41, which in turn is connected to spring 27 through chain 15. The chain 11 exits the control box 6, goes through hinge 5 (see FIGS. 16, 17) and the other end of the chain 11 is attached to the seat 2 in any conventional manner. When the toilet seat is raised from the position shown in FIG. 16 into the position shown in FIG. 17, the chain 11 pulls the chain 15 to the right in FIG. 7, which in turn pulls the trigger shuttle 36 from the position $P_1$ on the right side of FIG. 12 to the position $P_2$ on the left side of FIG. 12. This will stretch the spring 27.

When the seat 2 is released (when a person rises from the seat), the tension in the mainspring 27 is released and pulls the trigger shuttle 36 from the position $P_2$, show in the left of FIG. 12, to the position $P_1$, shown in the right of FIG. 12, and the toilet will be flushed as explained above. At the same time pull chain 11 is pulled back into the control box 6, which causes the seat to be lowered from the position shown in FIG. 17 to the position shown in FIG. 16, the at rest position, which is the same as shown in FIG. 2.

The handle pull chain 10 is connected at one end to the left side of the clasp shuttle 47 (see FIGS. 7 and 18–20). The chain then goes around a guide 29, then through hinge 4 (see FIG. 7) and continues up and is finally connected by means of a hook 49 to the flush handle 50 of the toilet in any conventional manner. If, for any reason, the user wants to disconnect the automatic flushing feature, he/she merely has to disengage the hook 49 from the flush handle 50. The automatic flushing mechanism will then operate normally except the toilet will not flush. The toilet can be flushed in the normal way at any time, whether the hook is attached to the handle or not, by simply turning the flush handle in the normal manner.

When the trigger shuttle 36 is pulled to the left (in FIG. 12), by either sitting on the seat 2 or raising the seat 2 to the upright position, the system is in the cocked position. If the toilet lid (toilet seat cover-not shown) is in the up position, the clasp shuttle track 45, which runs parallel to the trigger shuttle track 40, will connect to the trigger 37 via the clasp shuttle 47 and the shuttle clasp 46. When the trigger shuttle 36 is pulled to the right in FIG. 12, by the tension of main spring 27, either by removing the weight from the seat or otherwise releasing the seat, the trigger will connect to the clasp 46 thereby pulling the clasp shuttle 47 to the right (see FIGS. 20*d*–20*f*), this in turn will pull chain 10 which will flush the toilet.

The toilet lid pull chain 9 (see FIGS. 6 and 7) connects to the lower left corner of the clasp shuttle track box 45, then it exits through a tunnel in an extension 43 of the control box 6 and connects to the toilet lid in any conventional manner. Therefore, if the toilet lid is up, there is no tension on the chain 9 and the clasp 46 can be engaged by the trigger 37.

At the same time, the clasp shuttle track 45 is pivoted up to the position shown in FIG. 6. If the lid is lowered, the chain 9 is pulled out of the control box by way of the extension 43 against the tension of the clasp shuttle return spring 51 (see FIGS. 6 and 20*e*). This will cause the clasp shuttle track box 45 to be pivoted down (see FIGS. 7 and 20*e*) so the trigger 37 cannot engage the clasp 46, as shown in FIG. 20*e*. This configuration, with the lid lowered to the down position, is called the automatic disengage mode and allows a user to sit on the toilet lid and the toilet will not automatically flush when weight is removed from the lid.

Although the Jonnyflush and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention. Modified forms can include, but are not limited to:

1) Mirror images for toilets with flush handles on the right;
2) For commercial/public toilets, which do not have lids, the elimination of lid hinges, chain 9, extension 43, and the entire function of automatic disengagement.
3) A user controlled timed (say from 0 to 200 seconds) clockwork escapement, which engages when the seat is raised, and locks the seat upright while the clockwork runs down, at which time the toilet is flushed and the seat is lowered.
4) A user option to cause the lid to be lowered at the same time the seat is automatically lowered via a detachable spring on the lid's right hinge.

What I claim as my invention is:

1. An automatic flushing mechanism connected to a toilet, said toilet having a toilet seat and a toilet seat lid, both hingedly mounted to a toilet base, and a toilet flush tank affixed to said toilet base, said toilet flush tank having a handle for flushing said toilet, and wherein said automatic flushing mechanism comprises:

a control box attached to said toilet seat, said control box having means connected to said handle for automatically operating said handle when said a person's weight is removed from said toilet seat, and means connected to said toilet seat for activating said means connected to said handle.

2. The automatic flushing mechanism as claimed in claim 1, where said toilet seat has means connected thereto for preventing said toilet seat from being moved from a raised position to a lowered position.

3. The automatic flushing mechanism as claimed in claim 2, where said means for preventing said toilet seat from being moved from a raised position to a lowered position is a rod, said rod being connected at one end to said toilet seat, and said rod, on another end, engaging said toilet base.

4. The automatic flushing mechanism as claimed in claim 1, wherein said means connected to said toilet seat for activating said means connected to said handle, comprises:

at least a pair of rollers, one of said at. least a pair of rollers engaging said toilet base, and another of said at least a pair of rollers engaging said toilet seat.

5. The automatic flushing mechanism as claimed in claim 1, wherein one of said at least a pair of rollers has a rod connected thereto, and another end of said rod being connected to said means connected to said handle for automatically. operating said handle when a person's weight is removed from said toilet seat.

6. The automatic flushing mechanism as claimed in claim 5, wherein said another end of said rod is connected to a first end of a first flexible connector, and a second end of said first flexible connector is attached to a first end of a second flexible connector, and said second end of said first flexible connector and said first end of said second flexible connector are connected within said control box, and said second flexible connector is connected at a second end to a trigger shuttle at one end of said trigger shuttle, and said trigger shuttle is connected at another end to a spring, said trigger shuttle having having a trigger which engages a clasp on a clasp shuttle, and said clasp shuttle being connected to a first end of a third flexible connector, and another end of said third flexible connector is connected to said handle.

7. The automatic flushing mechanism as claimed in claim 6, wherein a fourth flexible connector is connected at one end to said clasp shuttle, and means for connecting another end of said fourth flexible connector to said toilet seat lid.

8. The automatic flushing mechanism as claimed in claim 6, wherein a fifth flexible connector is connected at one end to said second flexible connector, and means for connecting another end of said fifth flexible connector to said toilet seat.

9. The automatic flushing mechanism as claimed in claim 6, wherein said control box has means for allowing said trigger shuttle to disconnect from said clasp shuttle.

10. The automatic flushing mechanism as claimed in claim 9, wherein said means for allowing said trigger shuttle to disconnect from said clasp shuttle is a track which is connected to said clasp shuttle, said track pivoting from a first position in which said trigger shuttle and said clasp shuttle are connected, and a second position in which said trigger shuttle and said clasp shuttle are disconnected.

* * * * *